United States Patent [19]

Murat et al.

[11] 4,031,992

[45] June 28, 1977

[54] PRINTING DEVICE

[75] Inventors: Roger Murat; Guy Glay, both of Argenteuil, France

[73] Assignee: Societe d'Applications Generales d'Electricite et de Mecanique S A G E M, Paris, France

[22] Filed: Nov. 11, 1975

[21] Appl. No.: 630,923

[30] Foreign Application Priority Data

Nov. 14, 1974 France ..... 74.37624

[52] U.S. Cl. ..... 197/1 R; 101/93.05; 178/30

[51] Int. Cl.[2] ..... B41J 3/04

[58] Field of Search ..... 197/1 R; 101/93.04, 101/93.05; 178/23, 26, 30

[56] References Cited

UNITED STATES PATENTS

| | | | |
|---|---|---|---|
| 2,457,133 | 12/1948 | Deloraine | 178/30 |
| 3,209,681 | 10/1965 | Sanborn | 101/93.04 |
| 3,267,845 | 8/1966 | Simshauser | 101/93.04 |
| 3,330,208 | 7/1967 | Eckel | 101/93.04 |
| 3,627,096 | 12/1971 | Finnegan | 197/1 R |
| 3,934,695 | 1/1976 | Kovalick | 197/1 R |

*Primary Examiner*—Ralph T. Rader
*Attorney, Agent, or Firm*—Cushman, Darby & Cushman

[57] ABSTRACT

A printing device, for example of the needle impact type, is equipped with electrical means controlling the operation of the needles to produce alternative forms of printed data, for example letters of different degrees of inclination.

4 Claims, 10 Drawing Figures

Figure 4:
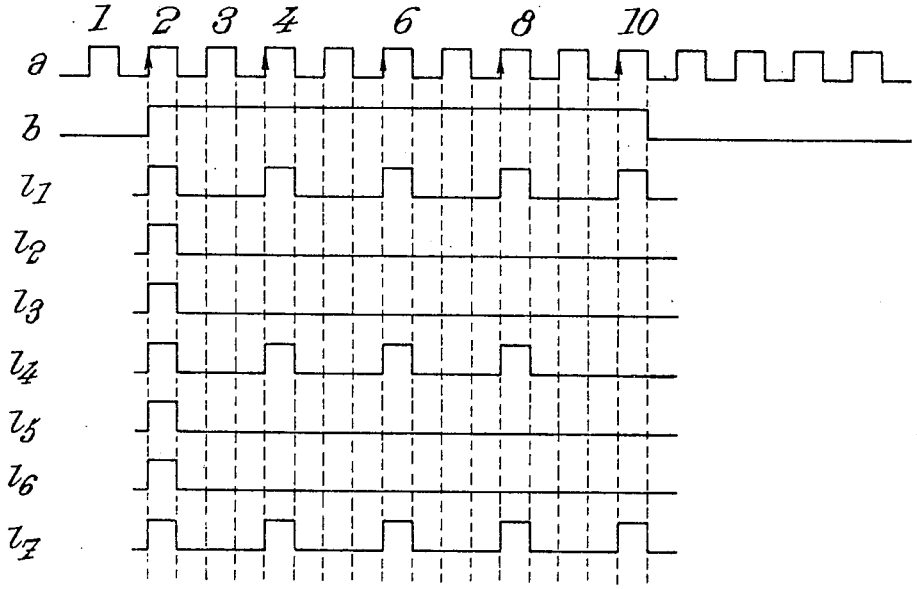

Fig. 2.
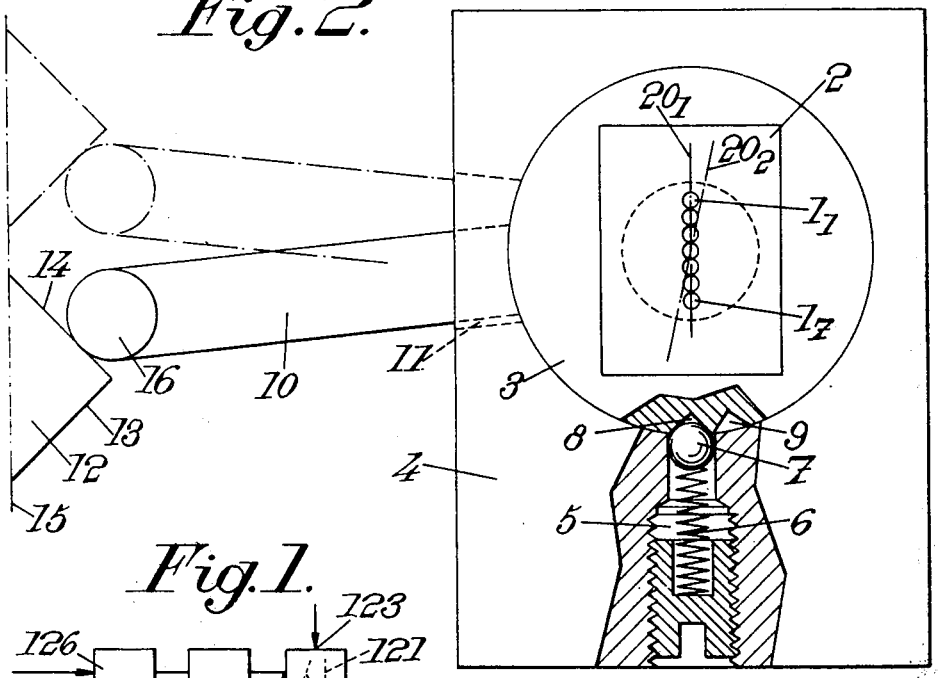
Fig. 1.
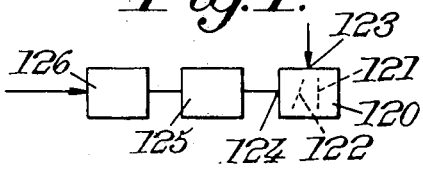
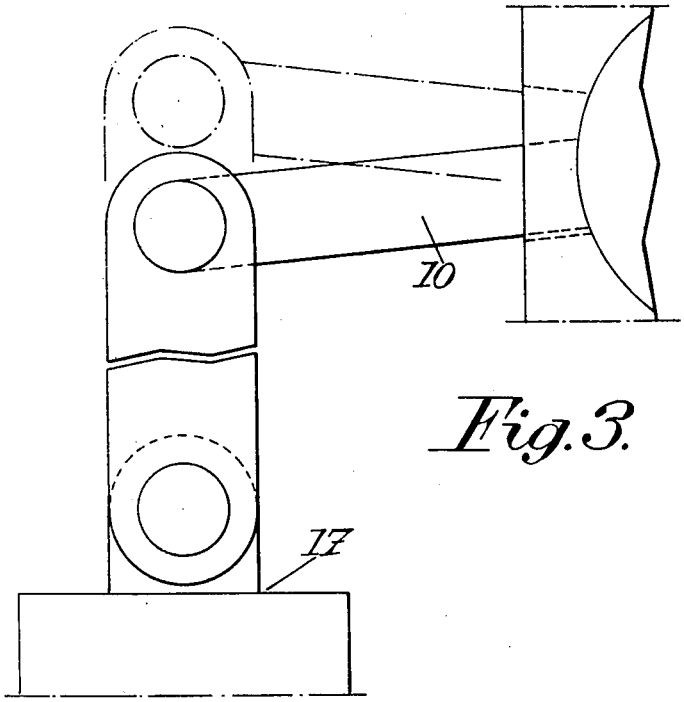
Fig. 3.

PRINTING DEVICE

This invention relates to improvements in devices for printing data. It is concerned more particularly with devices of this type which are adapted to inscribe data of a first and a second type and which comprise at least one member for printing the characters or symbols on a data receiving support, such as paper.

It is known that in the case of teleprinters to discriminate between transmitted data and received data, the transmitted text is printed in a first colour (generally red) and the received text in a second colour (generally black). Similarly in printing devices which are peripheral equipments to electronic computers the data which come without any error being signalled are generally inscribed in black whilst the information corresponding to errors are generally printed out in red. By the same token in the case of equipment ancillary to calculating machines when used for accounting the credits are printed in black and debits in red. These means of differentiating between information of first and second types are also found in typewriting machines; in fact these often comprise a two-colour ribbon. These known means for discriminating between two types of data are only useful when this data has to be printed on a signal support or substrate (such as a sheet of paper). In fact the conventional reproducing techniques, (carbon paper, photocopies etc) cannot reproduce the distinctive colours.

It is an object of the invention to avoid the drawbacks cited above. To this end the invention provides a device for printing data of at least two types, comprising at least one printing member, which may be a printing head, for printing characters, for example symbols, figures or other indicia, on a substrate (for example paper), means for operating said member to print characters of variable form on said substrate, and electrical means controlling said operating means so as to produce characters varied in response to the value of signals applied to said electrical means.

Advantageously means are provided for detecting the aforesaid signals and for relaying them to receiving means. In the application to teleprinters the data of the first type are received data and the data of the second type are transmitted data. In the case of the application of the invention to printing devices which constitute peripheral equipment of a computer, the data of the first types are those which carry no error (or credits in accountancy applications) whilst the data of the second type correspond to the errors (or to debits in the accountancy application). In the preferred embodiment of the invention the said electrical means comprise inclination means designed to impose first and second character forms with a first and second degree of inclination of the characters. For example the first degree of inclination can correspond to upright characters and what is referred to as the second degree of inclination can refer to inclined characters.

In an embodiment the aforesaid printing member can be of the needle impact type, the head of which is displaceable in a predetermined direction so as to inscribe the data in lines on said substrate, and this head comprises a guide for the active ends of the needles. The inclining means in this case are adapted to pivot the guide about an axis into first and second positions around this axis so as to impart to the characters first degree and second degree inclinations. Advantageously in this case the inclination means comprise an arm which is rigid with the guide, and means for operating this arm.

In a second embodiment the aforesaid printing member or head is also of the needle impact type and this head is displaceable in a predetermined direction so as to inscribe the data in lines on the aforesaid support, said needles being adapted to be projected selectively, at one end thereof, against the substrate so as to inscribe the symbols or characters in a predetermined point grid. In this second embodiment the said electrical means comprise first electronic circuits which are adapted to define, for each character, a sequence of projection of the needles against the substrate which will produce a first degree inclination, and second electronic circuits which will define for each of the characters such a sequence of projection of the needles that they will have the second degree inclination.

Figure 5:
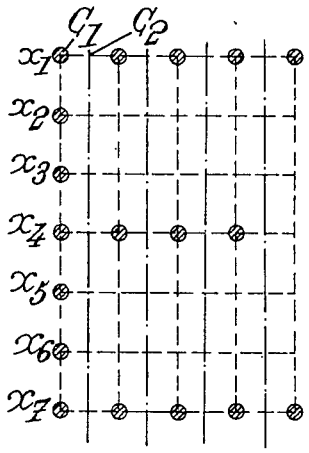
Figure 6:
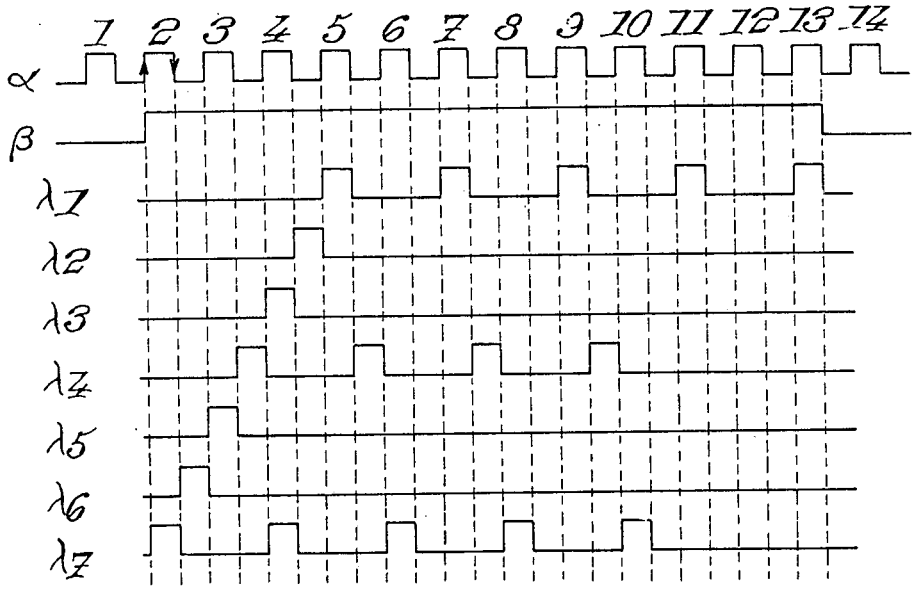
Figure 7:
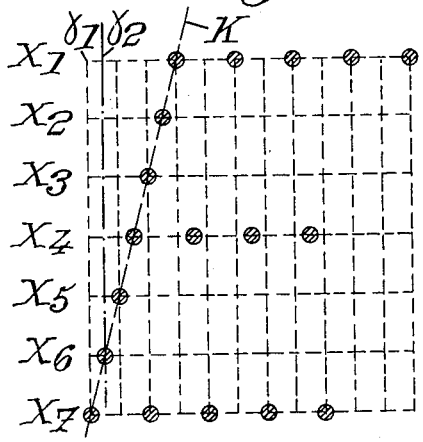
Figure 9:
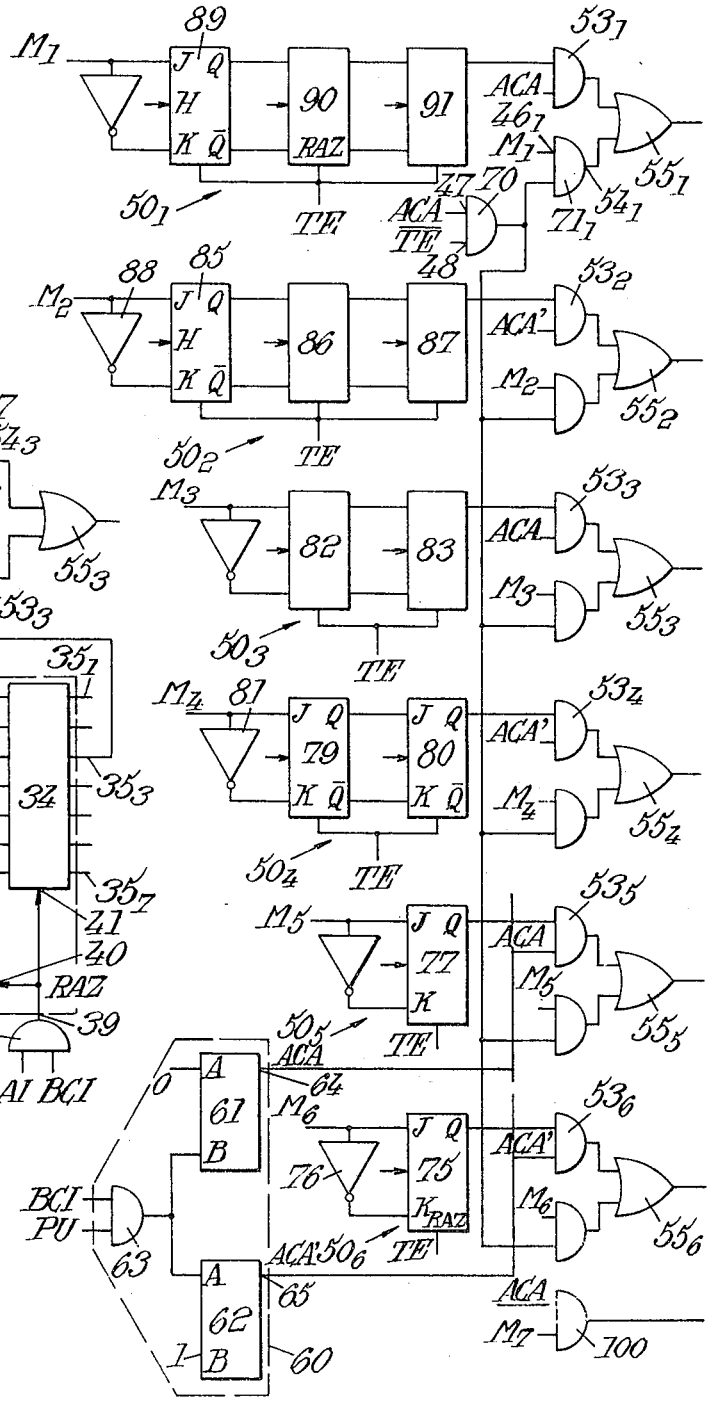
Figure 8:
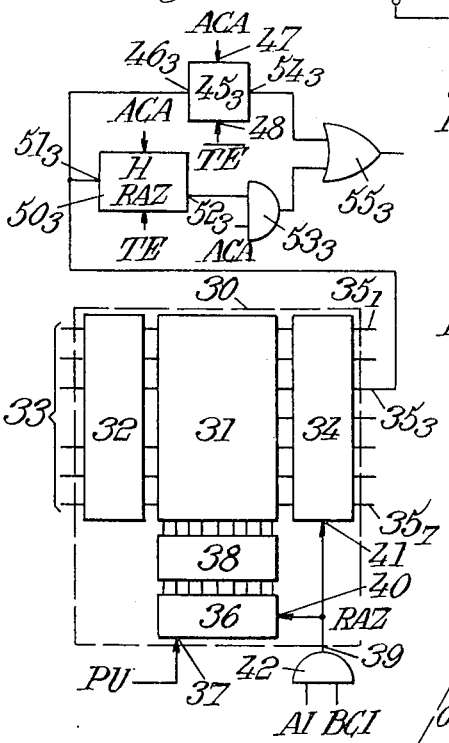
Figure 10:
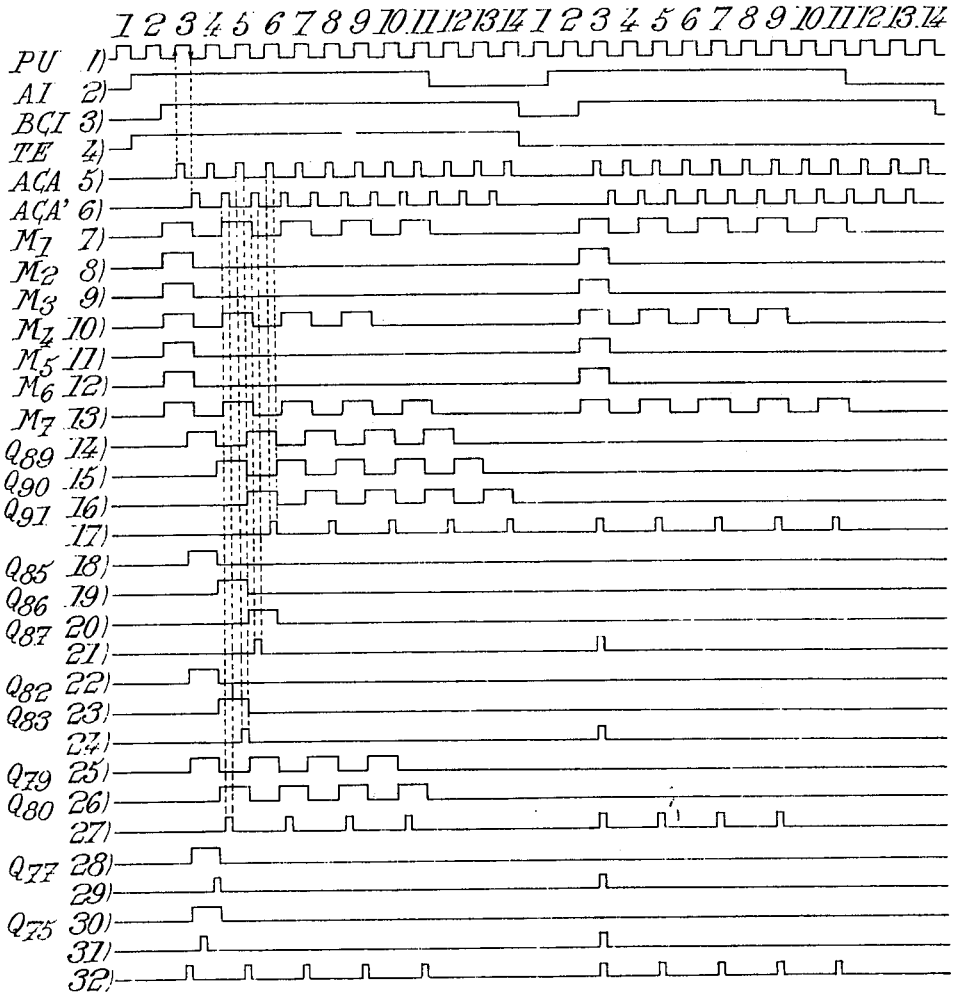

Other objects, features and advantages of the invention are disclosed hereafter in relation to preferred embodiments of the invention given in connection with the accompanying drawings in which:

FIG. 1 is a diagrammatic illustration of a device according to the invention presented here in the form of blocks, FIG. 2 is a diagrammatic illustration of a part of a printing device in accordance with the invention, this being shown partially in section, FIG. 3 illustrates a modification of the device illustrated in FIG. 2, FIG. 4 is a collection of diagrams representing the sequence of appearance of the control signals from the electromagnets of a needle impact printing head, arranged to inscribe the letter E in rectilinear (or upright) fashion, FIG. 5 illustrates the letter E inscribed as an upright character, FIG. 6 shows the sequence of control signals of the electromagnets of a needle printing head used in accordance with the invention to inscribe the letter E as an inclined character, FIG. 7 shows an inclined letter E produced by means of a needle printing head controlled by the signals indicated in FIG. 6, FIG. 8 shows in partial diagrammatic fashion a circuit in accordance with the invention for controlling the electromagnets of the needles of a printing head, FIG. 9 shows in a more detailed fashion certain parts of the circuit shown in FIG. 8, and FIG. 10 illustrates a group of diagrams illustrating the functioning of the circuits illustrated in FIGS. 8 and 9.

The principle of the invention is illustrated in very diagrammatic fashion in FIG. 1. The device according to the invention comprises first of all a member or head 120, for printing characters or symbols on a data support such as a sheet of paper. In accordance with the invention this member is so devised as to produce characters or symbols of a first or second form. In the examples which are described hereafter the first form is a rectangular or upright form symbolised by the interrupted line 121, and the second form is the inclined form symbolised by the line 122 which is of a dotted nature.

The member 120 comprises an input 123 controlling the printing of the characters (independently of their form) and an input 124 for controlling the form of the characters.

The input 124 is connected to the input of means 125 for receiving the signal which is adapted to feed in first and second values which respectively represent data of a first and second type respectively. In the case of a teleprinter, as has already been mentioned above, the data of the first type are the received data and the data of the second type are the transmitted data.

Discrimination between data of the first and of the second types is performed by detection means 126 the output of which is connected to the input of the reception or receiving means 125.

The example of the embodiment which will now be described in reference to the arrangement of FIG. 2 to 10 is concerned with a printing device such as a printer or a teleprinter which comprises a printing head of the needle impact type (not shown). A printing head of this type is described for example in French Pat. application No. 74 33 837 filed on the Oct. 8, 1974 for "Improvements in printing devices or heads for printers or the like and a method of the fabrication of such a printing head".

A printer of the type mentioned above is also described, by way of example, in French Pat. application No: 74 25 963 filed on the July 25, 1974 for "Improvements in printing devices".

It is known that with such printing devices each character or symbol is represented by a group of points which are distributed in such a way as to present the form of the desired character or symbol, (letter, numeral, sign etc). The number of points which can be selected for each character or symbol is limited because these points form part of a matrix or grid of X lines and Y columns. The points in question are located at the points of intersection of the lines of columns of these grids (these points are represented by the hatched circles in FIGS. 4 and 6). In a particular embodiment the number of lines X is seven whilst the number of columns Y is nine.

In operation the ends of the needles of such a printing head are generally distributed in such a way as to form a vertical column. A number of these ends is generally equal to the number of lines, that is to say seven in example. In operation, and as one will see later in relation to FIG. 4, these needle ends (not shown) as struck against an inking ribbon, arranged in front of a data support such as a sheet of paper. The striking of the needles against the inking ribbon is performed by means of electromagnets (not shown) energised by control signals following a sequence corresponding to the characters or symbols which it is intended to inscribe. A printing head of this kind is rigidly secured to a carriage (not shown) which is horizontally movable, generally at a constant speed.

To ensure that the active ends of the needles are always aligned along a rectilinear vertical line they are guided and supported by a suitable guide or a guide member having openings $1_1$–$1_7$ these being of a number equal to the number of needles.

In the examples of the embodiment of the invention which are to be described below the data of the first type (for example the reception in the case of a teleprinter) are inscribed in the usual way, that is to say in the form of rectilinear characters, whilst the data of the second type (corresponding to the transmission in the case of the teleprinter) are inscribed in the form of inclined characters in accordance with the present invention.

In the embodiments of the invention which are illustrated in FIGS. 2 and 3 the two possible orientations of the characters or symbols (at right angles or inclined are produced by giving the member 2 which performs the support guiding of the ends of the needles two different positions. The openings $1_1$to $1_7$ are provided in this member 2.

In the example illustrated in FIGS. 2 and 3 member 2 comprises two rectangular plates one only of which is seen in FIG. 2. The plates of member 2 are installed in housings provided at the perpendicular ends of a cylindrical support 3 for these plates 2. It will thus be readily understood that one only of the plates of the member 2 are visible in FIG. 2 because only a single perpendicular section to the support 3 can be seen in this figure.

The cylindrical support 3 may pivot about a substantially horizontal axis in a bearing 4. This support 3 may assume one or two well identified positions in this bearing 4. The first position corresponds to a vertical alignment of the axes of the openings $1_1$ to $1_7$ in the member 2; in the second position the axes in these overtures $1_1$ to $1_7$ are along a line which is inclined about ten degrees to the vertical direction.

To achieve these well-identified positions of the active ends of the printing needles means are provided for locking the support 3 in the two positions. To this end the bearing 4 has a recess 5 which forms a blind groove communicating with the opening in this bearing. A spring 6 which biasses a ball 7 towards the opening in the bearing 4 is arranged in this blind groove. Two cavities, respectively 8 and 9, are provided in the periphery of the cylindrical support 3 so as to provide seats for parts of each part of the body of the ball 7.

Similar locking means are known per se and their functioning and their advantages are wellknown.

To effect a pivoting of the cylindrical support 3 the printing device comprises an arm 10 (FIGS. 2 and 3) which is rigid with the aforesaid support. To this end the arm 10 is fixed to the periphery of the cylindrical support 3. This arm 10 projects out from the frame of bearing 4, and the latter is provided with a slot 11 to allow the arm 10 to pass through it. In addition this slot 11 extends sufficiently in a vertical direction to provide for pivoting of the arm 10 in the vertical plane for a predetermined angle which is at least equal to the angle formed between the two desired positions $20_1$ and $20_2$ of the line 20 connecting the axes of the openings $1_1$ to $1_7$ which guide the active ends of the needles.

Two different methods of effecting the pivoting of arms 10 are illustrated respectively in FIGS. 2 and 3.

In the example shown in FIG. 2 the operating means do not move with the printing head or its carriage. Thus this arrangement does not overload the movable carriage. It consists in providing on the frame (not illustrated) of the printing device in accordance with the invention a wedge 12 presenting two faces respectively denoted 13 and 14. This wedge 12 is disposed at one end of the frame at a position which corresponds to the beginning of the line, that is to say one end of the stroke of the carriage. This wedge 12 can be displaced in a vertical direction denoted by line 15 with the assistance for example of an electromagnet (not shown) to enable the wedge 12 to adopt two well defined and different positions. The first of these positions is illustrated in generally dotted lines, whilst the second is shown in full line in FIG. 2. A part of the arm 10 is also shown in chain dotted lines in FIG. 2 as well as the line $20_2$ to cater for the case where the characters or symbols to be inscribed are to be inclined.

It will be understood that the signal applied to the terminals of an electromagnet controlling the movement of wedge 12 can have two different values corresponding respectively to data of the first and of the second type.

When data of the second type is to be inscribed (transmission in the case of the teleprinter) for which characters of inclined form are required, the wedge 12 is placed in its lower position, viz. that illustrated in full line. Under these conditions when the carriage (not shown) carrying the printing head returns to its starting position, corresponding to the commencement of the line, the arm 10 is pivoted so as to take up the position illustrated in chain dotted lines in the drawing. It will be understood that the arm retains this position if, prior to this, it had the position illustrated in chain dotted lines. In fact, when the carriage carrying the printing head returns to its starting position the knob 16 disposed at the free end of this arm 10 first comes into contact with the lowermost part of surface 14; then as the carriage continues its travel towards the end of the starting position of this line the knob 16 slides on surface 14 and thus, knob 16 is raised and thus causes the arm 10 to be pivoted, the guide member will be consequently moved so that these elements take up the position illustrated in chain dotted lines. In this position the ball 7 is in its seat 9. If the line previously inscribed were also to correspond to transmission there would not be any contact between knob 16 and surface 14 and the member 2 would continue to occupy its inclined disposition.

In contrast if the data to be inscribed is of the first type, that is to say in the case of the teleprinter corresponding to characters of rectangular or upright reception signals, the wedge 12 is disposed in the position illustrated in chain dotted lines. In this case the bottom face 13 of the wedge 12 is the active face for controlling the pivotal movement of arm 10 in more precise fashion when the carriage carrying the printing head returns to the commencement of the line, and when the wedge 12 is in the position illustrated in chain dotted lines, the member 2 resumes the position represented in full line in FIG. 2 irrespective of its initial position and thanks to the cooperation between knob 16 and surface 13.

In the modification illustrated in FIG. 3 control of the pivotal movement of arm 10 is effected directly by means of electromagnet 17. This electromagnet 17 is rigid with the carriage which carries the printing head.

In this letter arrangement the carriage is loaded by the electromagnet 17, but the advantage of this arrangement lies in the fact that data of both a first type and a second type can be inscribed in a single line without the carriage having to be returned to its starting position.

In the embodiment of the invention which will now be described in reference to FIGS. 4 – 10 for the purpose of inscribing upright or inclined characters, in contrast to the embodiments described above, the ends of the needles of the printing heads are always in the same relative position (vertical for example). However, the sequence of control signals is different depending on whether data of a first type or of a second type is to be inscribed.

To this end use is made a first circuits adapted to produce signals controlling the electromagnets and the needle for inscribing upright characters or symbols, and second circuits of the same kind for inscribing inclined characters or symbols.

FIG. 4 shows the distribution, as a function of time, of the signals which are used to control the aforesaid electromagnets for the purpose of inscribing the letter E of upright character. This letter E is illustrated in FIG. 5. A method of inscribing upright characters of this nature is per se known but it is here described to give a better comprehension of the method and means in accordance with this invention for inscribing inclined characters, which will be described in reference to FIGS. 6, 7, 8, 9 and 10.

The line *a* of FIG. 4 is a diagram illustrating the variation, as a function of time, of the so-called "clock" signals. These signals are in the form of square pulses of a predetermined length. The line *b* of FIG. 4 represents a signal initiating the printing. Lines $l_1$ to $l_7$ of this FIG. 4 illustrate control signals applied to the electromagnets which control the projection of the needles to inscribe an upright E. Line $l_1$corresponds to the signals applied to the electromagnet associated with the needle the active end of which is at the most elevated position, whilst the line $l_7$ corresponds to pulses applied to the electromagnet associated with the needle of which the active end is at the lowermost position.

As will be seen from FIG. 4 when the second "clock" pulse is produced a control pulse is applied simultaneously to all the electromagnets. When the fourth, sixth and eighth clock pulses appear, the control pulses are then applied to the first, fourth and seventh electromagnets. When the tenth clock pulse arrives, a pulse is also applied to the first and seventh electromagnets. The lines $l_1$ to $l_7$ of FIG. 4 correspond respectively to the lines $x_1$ to $x_7$ of FIG. 5.

The grid with which we are here concerned in this example correspond to the standard ECMA 42. In this standard the spacing, or step, between two characters is 2.54 mm and the minimum step between two vertical columns is 0.181 mm. Thus the step between two characters corresponds to fourteen columns. When an upright character is being inscribed, as illustrated in FIG. 4, nine columns only of the fourteen are used; the other columns serve to provide spacing between the characters.

A method in accordance with the invention for inscribing inclined characters will now be described with reference to FIGS. 6 and 7. In this method the number of columns of the grid which are normally utilised for inscribing upright characters or symbols is increased in units. The inclination of the characters or symbols obtained will depend on the number n of supplementary columns. In other words the printing start signal (represented on the line $\beta$ of FIG. 6) corresponds, for a given character or symbol, to a number of clock pulses (the line $\alpha$ of FIG. 6) greater than in the case of the printing of the same characters or symbol in upright printing (line b of FIG. 4). Moreover in the example illustrated in FIGS. 6 and 7 the successive columns of the grid are separated by an interval equal to half that separating two successive columns of the grid in FIG. 5. Stated otherwise, the interval separating columns $\gamma_1$ and $\gamma_2$ (FIG. 7) is equal to half the interval separating columns $C_1$ and $C_2$ of FIG. 5.

It is to be noted that when upright characters or symbols are being printed the separation between two successive columns ($C_1$ and $C_2$ for example) corresponds to one period of the clock signal. In contrast, in the case of FIG. 6 the interval separating two successive columns corresponds to half of one period. In the first case, as can be seen from FIG. 4, the control signals of the electromagnets associated with the needles only appear for the "1" of the clock signal. In contrast in the second case, as shown by FIG. 6 and as will be seen in FIG. 10, the control signals for the electromagnets appear as often for the "0" as for the "1" of the clock signal. In other words it can also be said that in the case of the printing of upright characters or symbols the control signals are only at the rising flanks (or edges) of the clock signal whereas, in the case of inclined characters the control signals of the electromagnets are emitted both for the rising and the falling flanks of the clock signal.

For example as illustrated in FIG. 6 for the inscription of an inclined E a control signal for the electromagnet corresponding to the needle of the lowermost needle end appears at the same time as the second clock signal (line λ 7, FIG. 6). As shown by the line λ 6 in FIG. 6 the electromagnet corresponding to the needle which has its end at the second position up from the bottom is energized between the appearance of the second and third clock pulses, that is to say at the instant of an "O" of said clock signal.

The implementation of the method described in relation to FIGS. 6 and 7 may be performed in various ways.

In the case where the printing is controlled by clock signals of well-determined period, independently of the mechanical parts operating the printing head, it is possible to imprint inclined characters or symbols by staggering (relatively to the printing of upright characters) the control signals of the electromagnets for the needles for a period determined for each of these. This staggered timing may be affected using one-shot multivibrators (or monostables, not shown) buffers. Thus in the case of the needle which is intended to print line $x_7$ no such monostable is needed; in contrast for the needle which is intended to inscribe line $x_6$ use is made in the feed circuit of the corresponding electromagnet of a monostable which applies a delay of time $t_1$; this timelag $t_1$ corresponds to the distance between the columns $\gamma_1$ and $\gamma_2$ (FIG. 7). For the feed circuit of the electromagnet associated with the needle which is intended to print the line $x_5$ use is made of a monostable which imposes a delay of duration $2t_1$ in the control of the corresponding needle etc.

An embodiment of the invention which will now be described with reference to FIGS. 8, 9 and 10, which is preferred to the embodiment above, is applicable both in the case where the printing is synchronised with signals transmitted by a coding means (not shown) representative of the position of the printing head, and in the case of clock pulses independent of this position.

The circuit illustrated in FIG. 8 comprises, first of all, a generator 30 which will be termed a "generator of characters or symbols". This generator 30 is known per se; to simplify FIG. 9 the generator 30 has not been illustrated thereon. It comprises a ROM 31 (read only memory) with six inputs and seven outputs. The six inputs of the memory 31 are connected to six outputs of a decoder 32 of the addresses of the characters. The six inputs of decoder 32 are directly connected to six inputs 33 of the generator 30. Each of the seven outputs of the memory 31 is connected to an output amplifier. To simplify the illustration the seven output amplifiers have been shown in the form of a block 34. The output of each amplifier is connected to a preselected output of the generator 30. These outputs of generator 30 are marked with references $35_1$ to $35_7$.

Generator 30 also comprises a counter for the number of columns 36 this having an input 37 to which is applied the clock signal PU, as will be seen later. This counter 36 comprises four outputs which, in this example, are connected respectively to four inputs of a column decoder 38 which has nine outputs connected to nine corresponding (column staggering) inputs of the memory 31.

Generator 30 comprises a zero-reset input 39 (RAZ) which is connected to a corresponding input (zero re-setting 40 of the counter 36 and a blocking input 41 of each of the amplifiers 34.

The input 39 is connected to the output of an AND gate 42 with two inputs. The signal AI (line 2 of FIG. 10) is applied to the first of these inputs and the signal BCI (line 3 of FIG. 10) is applied to the second input of this gate 42. The role of signals AI and BCI will be explained below in relation to the figure.

The binary signals representing the binary figure corresponding to one column of the character or symbol which is to be inscribed on the data support (paper) appear at the seven outputs $35_1$ to $35_7$ of generator 30. In the example now considered these columns are nine in number. It should be here pointed out that in the case of the inscription of upright characters vertical columns are involved, for example the column $C_1$ of FIG. 5; in contrast, in the case of inclined characters such a column has been inclined through the desired angle. Thus in FIG. 7 we are concerned with the column represented by the inclined line K which, in the case of FIG. 5 corresponds to column $C_1$.

The counter 36 is of the nine position type (corresponding to nine columns of the grid). When the input 37 of this counter 36 receives a first pulse the signals appearing at the outputs of this counter represent the numeral 1 and when the input 37 receives a *n*th pulse (*n* being limited to nine) the signals emitted at the outputs of this counter represent the figure *n*. To such signals which are furnished at the outputs of the counter 36, and thus at the corresponding inputs (column staggering) of the memory 31 correspond at the outputs $35_1$ and $35_7$ signals representative of the *n*th column of the character (or symbol) which is to be inscribed. This character or symbol is likewise represented (in accordance with another code) by the binary signals applied at the inputs 33 of generator 30.

The signals $M_1$ to $M_7$ which appear respectively at the outputs $35_1$ to $35_7$ of the generator 30, during the inscription of the character E (inclined and upright) have been represented on the lines 7 to 13 of FIG. 10.

As explained below in accordance with this invention means are provided for, at least for certain of the needles, transmitting signals $M_1$ to $M_7$ without any imposed delay (for upright printing) to the windings of electromagnets associated with the needles and — in the case of inclined printing — means for delaying the application of these signals $M_1$ and $M_7$. The appropriate control means (signal generator TE) enable one or the other of said means to be chosen, that is to say to allow for transmission of the signals $M_1$ to $M_7$ with or without an applied delay.

Each of the outputs $35_1$ to $35_6$ is connected in accordance with this invention to an AND gate member 45. More precisely, an AND gate member 45 corresponds to each output of generator 30. To simplify illustration only the member $45_3$ has been illustrated in FIG. 8.

This member $45_3$ comprises three inputs of which the first, designated $46_3$, is directly connected to the output $35_3$. The second input 47 of member $45_3$ is adapted to receive a signal ACA which will be termed "a starting signal for needle control" and this is represented on the line 5 in FIG. 10. A signal $\overline{TE}$ representing, depending on its value (binary), instructions to print upright, is applied to the third input 48 of member $45_3$. This signal $\overline{TE}$ is the complement of signal TE, the variations of which, as a function of time, are illustrated on the fourth line of FIG. 10.

Each of the outputs $35_1$ to $35_6$ is also connected in accordance with the invention, to the serial input of a shift register 50. In other words a predetermined shift register corresponds to each output $35_1$ to $35_6$. Only the shift register $50_3$ has been illustrated in FIG. 8. As may be seen from this figure the serial input $51_3$of register $50_3$ is connected to the output $35_3$ of generator 30. The clock input H of the register $50_3$ receives the said signal ACA (line 5 of FIG. 10). The signal TE (line 4 of FIG. 10) is applied to the zero re-set input RAZ of register $50_3$. The serial output $52_3$ of register $50_3$ is connected to the first input of a two-input AND gate $53_3$. The second input of AND gate $53_3$ is adapted to receive the signal ACA (line 5 of FIG. 10). As will be seen later in relation to FIG. 9 certain of the second inputs of the gates 53 receive the signal ACA whilst the second inputs of the other AND gates 53 receive a signal ACA' instructing the operation of a needle, the variations of which as a function of time are illustrated in line 6 of FIG. 10.

The output $54_3$ of member $45_3$ is connected to the first input of a OR gate $55_3$. The output from AND gate $53_3$ is connected to the second input of OR gate $55_3$. The signal which is set up at the output of OR gate $55_3$ is intended to energize the winding of the electromagnet associated with the third needle.

As regards output $35_7$, as can be seen from FIG. 9 this is connected directly to the first input of an AND gate 100 which comprises a second input to which the signal ACA is applied. The output from AND gate 100 directly supplies the winding of the electromagnet associated with the seventh needle.

Although the operation of the circuit which has just been described in relation to FIG. 8 will be described in more detail later in reference to FIGS. 9 and 10, it is to be noted that for the inscription of upright characters or symbols there is applied to the input of the zero re-set RAZ of the register 50 a signal which keeps the signal delivered to output 52 at value 0. In contrast in this case (which is the writing characters or symbols) the signal applied to the input 48 of members 45 has the value 1.

There will now be a description in more detail, referring to FIG. 9, the AND gate members 45, the shift registers 50 and the means for generating the signals ACA and ACA'.

These signals ACA and ACA' are produced by an arrangement 60 comprising two one-shot multivibrators or monostables 61 and 62. The input B of the one-shot 61 is connected to the output of a two-input AND gate 63. The first of the two inputs of this gate 63 are adapted to receive a signal BCI (line 3, FIG. 10) which will be referred to later and the second input is adapted to receive the signal PU (line 1 of the diagram of FIG. 10). The signal PU is the same as that which is applied to input 37 of counter 37 of generator 30. The output of AND gate 63 is likewise connected to the input A of the monostable 62.

Input A of monostable 61 receives a signal representing the binary figure 0. The input B of the monostable 62 receives a signal representing the binary figure 1. It is the output 64 of monostable 61 which emits the signal ACA and the output 65 of monostable 62 which imparts the signal ACA'. The one-shot multivibrators 61 and 62 are adjusted in such a way that they impart pulses of equal periods. As shown by FIG. 10 the period of each pulse ACA or ACA' is less than that of each pulse of signal PU.

The AND gate members 45 comprise, in common, an AND gate 70 with two inputs 47 and 48. The input 47 receives the signal ACA and input 48 receives the signal $\overline{TE}$. Moreover each member 45 comprises and AND gate 71. Thus the member $45_1$ comprises the two-input AND gate $71_1$, the first of these inputs being connected to the output of AND gate 70 and the second input constituting the input $46_1$ of member $45_1$, which input is connected to the output $35_1$ to generator 30. The output of AND gate $71_1$constitutes the output $54_1$ of member $45_1$.

As shown in FIG. 9, the second inputs of the AND gates $53_1$, $53_3$, $53_5$ and of gate 100 receive the signal ACA and the second inputs of AND gates $53_2$, $53_4$ and $53_6$ receive the signal ACA'. The shift register $50_6$ comprises a single Flip-Flop (FF) 75 of JK type. The input J of this Flip-Flop 75 is connected to the outputs $35_6$ of generator 30. The input K of this Flip-Flop 75 is connected to the same output $35_6$ with the intermediary of an inverter 76. The output Q of Flip-Flop 75 is connected to the first input of AND gate $53_6$. The zero pre-set input RAZ of Flip-Flop 75 is adapted to receive a signal TE whilst the clock input H of the said Flip-Flop is connected to the output 64 of the one-shot multivibrator 61.

Furthermore the shift register $50_5$ comprises only one Flip-Flop 77 which is connected in a manner similar to Flip-Flop 75. The input J of FF 77 is connected to the output $35_5$ of the generator 30 and the output Q of this FF 77 is connected to the first input of AND gate $53_5$.

The shift register $50_4$ comprises two Flip-Flops of JK type, respectively 79 and 80. The input J of FF 79 is connected to the output $35_4$of generator 30 whilst the input K of this FF 79 is connected to the output $35_4$ with the intermediary of an inverter 81. The output Q of FF 79 is connected to the input J of FF 80 and the output $\overline{Q}$ of the FF 79 is connected directly to the input K of FF 80. It is the output Q of FF 80 which is connected to the first input of AND gate 53. The zero re-set inputs RAZ of each of the FF 79 and 80 are adapted to receive the signal TE whilst the output 64 of the one-shot 61.

The shift register $50_2$ also comprises two FF 82 and 83 connected in the same way as FF 79 and 80.

The shift register $50_2$comprises three Flip-Flops of JK type, these respectively being 85, 86 and 87. The input J of FF 85 is connected to output $35_2$ of generator 30 and input K of said FF 85 is connected to output $35_2$ through an inverter 88. Output Q of FF 85 is connected to the input J of FF 86; similarly the output $\overline{Q}$ of FF 85 is connected to the input K of FF 86. The outputs of the FF 86 are connected to the inputs of FF 87 in the same way as the outputs of FF 85 are connected to the inputs of FF 86. The output Q of FF 87 is connected to the first input of AND gate $53_2$. The signal TE is applied to the inputs of the zero re-set RAZ of FF 85, 86 and 87.

Finally the signal ACA (furnished by the output 64 of the monostable 61) is applied to the clock inputs H of said FF 85, 86 and 87.

Like the shift register $50_2$ register $50_1$ comprises three FF, namely 89, 90 and 91. These FF are connected up in the same way as the FF 85, 86 and 87.

The operation of the circuits which have just been described in connection with FIGS. 8 and 9 will now be explained in relation to FIG. 10.

Line 1 of FIG. 10, as has been mentioned above, represents the variations of the signal PU as the function of time. In the example illustrated this signal PU is delivered by a coding device (not illustrated putting out pulses at a rate associated with the movement of the carriage (not shown) carrying the printing head. It will be understood that the signals PU could be replaced by signals imparted from a timing generator. Signals PU comprise 14 pulses (corresponding to 14 columns) between two characters. These pulses have been numbered 1 to 14 on line 1 of FIG. 10 and these signals have been represented over an interval corresponding to two characters. The first part of the diagram is concerned with the writing of an inclined E and the second part with the printing of an upright E.

Line 2 of FIG. 10 represents the signal AI. This signal AI which is applied to one input of AND gate 42, takes the value 1 as soon as the first pulse PU disappears and resumes the value 0 when the eleventh pulse PU disappears. Thus the length of a pulse of this signal AI corresponds to ten periods of signal PU. Line 3 represents the variations of signal BCI which is a signal produced when it is intended to print a character or symbol (whether it is upright or inclined) which takes the value 1 as soon as the descending (or falling) flank of the second pulse PU appears and which resumes value 0 when the fourteenth pulse disappears. The signal BCI thus has the value 1 for a period corresponding to twelve pulses PU and thus to twelve columns.

FIG. 10 shows that signals AI and BCI simultaneously have the same value 1 for a time corresponding to nine periods of signal PU. In other words the counter 36 is held at zero before the second pulse PU disappears and after the disappearance of the eleventh pulse PU. The counter 36 may thus count nine pulses.

As has already been mentioned the signals ACA represented on line 5 of FIG. 10 are produced by the one-shot multivibrator 61. It is to be noted that this one-shot 61 is started at the rising flank of the pulses at its input B. In contrast one-shot 62 is started at the falling flank of the pulses applied to its input A as shown by the lines 1 and 6 of FIG. 10. In other words pulses ACA' have a constant value phase shift relatively to pulses ACA.

As regards the duration of each pulse of signals ACA or ACA' it should be noted that this duration is equal to the necessary periods of application for the signal to the terminals of the windings of the electro magnets associated with the needles. This duration is thus a function of the printing head which is utilised.

Signals 7 to 13 represent the signals $M_1$ to $M_7$ appearing respectively at the outputs $35_1$ to $35_7$ of generator 30 where the letter E is to be inscribed.

Line 14 of FIG. 10 represents the signal which is delivered at the output Q of FF 89 to the shift register $50_1$. Line 15 illustrates the signals delivered at the output Q of FF 90 and line 16 shows the signals which will appear at the output Q of FF. 91.

Line 17 illustrates the signals furnished at the winding of the electromagnet which controls the stroke of the first needle, that is to say the signals which appear at the output of OR gate $55_1$.

Lines 18, 19 and 20 represent the signals which appear at the outputs Q respectively of FF 85, 86 and 87. Line 21 shows the signal which appear at the output of OR gate $55_2$.

Lines 22 and 23 show the signals which appear at the outputs Q of the Flip-Flops 82 and 83 respectively, and line 24 illustrates the signals furnished at the output of OR gate $55_3$.

Similarly lines 25 and 26 show the signals which appear at the outputs Q of the FF, namely 79 and 80 respectively, and line 27 illustrates the signal which appears at the output of OR gate $55_4$.

Line 28 shows the signal which is furnished at the output Q of FF 77 and line 29 shows the signal which appears at the output of OR gate $55_5$.

Line 30 shows the signals which are delivered at the output Q of FF 75 and line 31 illustrates the pulses which appear at the output of OR gate $55_6$.

Finally line 32 represents the signals delivered at the output of AND gate 100, that is to say the signals which are imparted to the winding of the electromagnet which controls the impact stroke of the seventh needle of the printing head.

As is well shown by FIG. 10 the signals delivered at the outputs Q of the FF of the various shift registers all have the value 0 when it is intended to inscribe an upright E, because the signal TE applied to the input of the zero re-set RAZ of these FF has a value 0 and thus holds the output Q of these FF at 0.

No shift register is associated with the control circuits of the seventh needle. For this reason the lowermost line of the printing grid of each character or symbol is identical both for an upright inscription and an inclined one. On the other hand shift registers are associated with the other control circuits. For example, in the case of the sixth needle the control pulses applied to the winding of the associated electromagnet are furnished, in the case of an inclined letter, when the signal ACA' (line 6) and the signal represented by the line 11 have simultaneously the value 1. Similarly the signal (line 29) delivered to the winding of the electromagnet associated with the fifth needle appears when the signal ACA and the signal furnished at the output Q of FF 77 simultaneously are of value 1. The signals applied to the windings of the electromagnets associated with the fifth and sixth needles thus have a phase shift similar to the signals ACA and ACA', that is to say there is a spacing corresponding to columns $\gamma_1$ and $\gamma_2$ (FIG. 7).

Thus it has been possible with the aid of shift registers $50_1$ to $50_6$ and with the signals ACA and ACA', to achieve imprinting delays for the needles 1 to 6 which enable the columns to be imprinted in inclined disposition. It is to be noted that the conjoint use of signals ACA and ACA' enables the number of FF in the shift registers to be reduced.

Although in the embodiments of the invention described above there has been predominantly the question of discrimination between upright and inclined characters, it will be understood that the invention applies in the general way to all characters of different forms. For example in the case of a printing head utilised in the principle of impact needles the circuits can be arranged in such a way as to produce various shapes of character.

In the examples given above the case of teleprinters having a distinction between reception data and transmitted data has been envisioned. The invention may also be applied to the discrimination between data which is spoiled by some error and data which is unspoiled in a case where the printing device has a printing unit which constitutes a peripheral equipment of a computer. It may also be applied to discrimination between credit and debit items in the case of calculating machines.

Apart from the applications envisaged above (teleprinter or imprinting) it can be pointed out that the printing device according to the invention may equally well be used as a writing machine, a printing machine etc.

We claim:

1. A device for printing data comprising:

at least one printing member of the needle impact type and including a printing head movable in a predetermined direction so as to inscribe the data in lines on a substrate;

a plurality of needles carried by said head for selectively projecting against said substrate at one end, so as to inscribe characters on a predetermined point grid;

synchronizing means for generating pulses in synchronism with the movement of said printing head in said predetermined direction, each of said pulses corresponding to a column of said point grid;

upright character generator means connected to said synchronizing means and producing at an output for each needle, a sequence of pulses for causing projections of said needle against the substrate in order to inscribe a given upright character, said sequence depending on the character to be inscribed and being controlled by the pulses generated by said synchronizing means;

a plurality of OR gate means each comprising a first and a second input, the first input being connected at the output of said upright character generator means;

for each needle, with the exception of one needle in an extreme position, a shift register having a clock input and a serial input for receiving pulses from the corresponding output of said upright character generator means and a serial output, the clock input of said shift register receiving pulses from said synchronizing means, and the serial output of each shift register being connected to the respective second input of a corresponding OR gate means, the number of stages of said shift register depending on the position of said needle and determining the delay between receipt of a pulse from said generator means and appearance of that pulse at the serial output; and control means for inhibiting the output of the respective shift register when it is desired to inscribe upright characters and preventing the application of a signal to said first input of the OR gate means when it is desired to inscribe an inclined character.

2. A device according to claim 1, in which the synchronizing means includes two outputs for respectively delivering first pulses in synchronism with the displacement of said printing head and second pulses representing a constant phase shift relative to the first pulses, a plurality of AND gate means, the serial output of each shift register being connected to the first input of a corresponding AND gate means, the second input of said AND gate means being connected to one of said first and second outputs of said synchronizing means, two adjacent needles being connected to different outputs of said synchronizing means, and the output of said AND gate means being connected to the second input of the respective OR gate means.

3. A device according to claim 2 in which said synchronizing means comprises:

first and second one-shot multivibrators, the first and second outputs of said synchronizing means being the outputs of said first and second one-shot multivibrators, respectively;

a synchronizing member for generating pulses in synchronism with the movement of the printing head and having an output connected to a first input of the first one-shot multivibrator and to the second input of the second one-shot multivibrator;

means for applying a binary signal of a first value on the second input of the first one-shot multivibrator; and means for applying a binary signal of the second value on the first input of the second one-shot multivibrator.

4. A device according to claim 1 in which said control means comprise means for discriminating reception and transmission data in order to print upright or inclined characters as a function of said discrimination.

* * * * *